US011233358B2

(12) United States Patent
Sekino et al.

(10) Patent No.: US 11,233,358 B2
(45) Date of Patent: Jan. 25, 2022

(54) LEVER-TYPE CONNECTOR

(71) Applicant: YAZAKI CORPORATION, Tokyo (JP)

(72) Inventors: Tetsuya Sekino, Makinohara (JP); Hiromasa Kubota, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/924,149

(22) Filed: Jul. 8, 2020

(65) Prior Publication Data

US 2021/0013673 A1 Jan. 14, 2021

(30) Foreign Application Priority Data

Jul. 11, 2019 (JP) ..... JP2019-129335

(51) Int. Cl.

| | |
|---|---|
| ***H01R 27/02*** | (2006.01) |
| ***H01R 13/629*** | (2006.01) |
| ***H01R 13/514*** | (2006.01) |
| ***H01R 13/516*** | (2006.01) |

(52) U.S. Cl.

CPC ..... *H01R 13/62938* (2013.01); *H01R 13/514* (2013.01); *H01R 13/516* (2013.01); *H01R 27/02* (2013.01)

(58) Field of Classification Search

CPC .... H01R 13/18; H01R 13/20; H01R 13/2421; H01R 13/2428; H01R 13/4534; H01R 13/506; H01R 13/6315; H01R 13/633; H01R 13/745; H01R 13/62933; H01R 13/62955; H01R 13/62977; H01R 35/04; H01R 41/00

See application file for complete search history.

(56) References Cited

U.S. PATENT DOCUMENTS 3,291,926 A * 12/1966 Nelson ..... H01R 13/523 200/51 R
3,452,321 A * 6/1969 Carissimi ..... H01R 13/46 439/483

(Continued)

FOREIGN PATENT DOCUMENTS

JP 2006-216331 A 8/2006
JP 2009-26488 A 2/2009

(Continued)

*Primary Examiner* — Truc T Nguyen

(74) *Attorney, Agent, or Firm* — Kenealy Vaidya LLP

(57) ABSTRACT

A lever-type connector includes a connector body including side walls and a boss portion and a lever including a pair of arm portions, each of the pair of arm portions being provided with a boss fitting hole into which the boss portion of the connector body is to be inserted, the lever being to be rotatably attached to the connector body. The connector body and the lever includes a first and second alignment marks, the first alignment mark and the second alignment mark being visually recognizable while the lever is being attached to the connector body. The lever is, by aligning the second alignment mark with the first alignment mark, to be rotatably attached to the connector body with a position of the boss portion and a position of the fitting hole being aligned with each other, allowing the boss portion to be inserted into the boss fitting hole.

5 Claims, 10 Drawing Sheets

(56) References Cited

U.S. PATENT DOCUMENTS

| | | | | |
|---|---|---|---|---|
| 5,823,813 | A * | 10/1998 | Dye | H01R 13/62905 439/347 |
| 9,583,860 | B1 * | 2/2017 | DeWitte | H01R 13/436 |
| 2002/0019156 | A1 | 2/2002 | Fukamachi et al. | |
| 2003/0022538 | A1 * | 1/2003 | Langolf | H01R 13/6295 439/157 |
| 2006/0172602 | A1 | 8/2006 | Sakakura et al. | |
| 2007/0202722 | A1 | 8/2007 | Sasaki et al. | |
| 2009/0023316 | A1 | 1/2009 | Takahashi et al. | |
| 2010/0048053 | A1 * | 2/2010 | Tonosaki | H01R 13/62938 439/299 |
| 2011/0230106 | A1 * | 9/2011 | Shamoto | H01R 13/62938 439/892 |
| 2012/0208383 | A1 * | 8/2012 | Kobayashi | H01R 13/62955 439/133 |
| 2013/0102172 | A1 * | 4/2013 | Kobayashi | H01R 13/62933 439/157 |
| 2014/0370733 | A1 * | 12/2014 | Hashimoto | H01R 13/62938 439/157 |
| 2015/0011106 | A1 * | 1/2015 | Kamiya | H01R 13/62955 439/157 |
| 2018/0138628 | A1 | 5/2018 | Matsumoto | |
| 2018/0226744 | A1 * | 8/2018 | Matsuura | H01R 13/5841 |
| 2019/0074633 | A1 | 3/2019 | Ogashira | |

FOREIGN PATENT DOCUMENTS

| | | | |
|---|---|---|---|
| JP | 2010-92888 | A | 4/2010 |
| JP | 2018-81847 | A | 5/2018 |

* cited by examiner

LEVER-TYPE CONNECTOR

CROSS-REFERENCE TO RELATED APPLICATION

The present application claims priority to Japanese Patent Application No. 2019-129335 filed on Jul. 11, 2019, the entire content of which is incorporated herein by reference.

TECHNICAL FIELD

The present invention relates to a lever-type connector.

BACKGROUND

In a related art lever-type connector, a lever rotatably provided on a connector body is rotated, thereby assisting fitting and detachment of the connector body with respect to a mating connector see, for example, JP2009-26488A, JP2018-81847A). In such a lever-type connector, the lever includes a pair of arm portions and a coupling portion coupling the two arm portions, and has a U-shaped cross section. When the lever is attached to the connector body, the pair of arm portions is elastically deformed outward and boss portions provided on two outer side surfaces of the connector body are inserted into boss fitting holes provided in the two arm portions, thereby making the lever rotatable.

However, when attaching the lever to the connector body of the lever-type connector above, an operator need to check positions of the boss fitting holes of the lever with respect to the boss portions of the connector body by looking at the connector body and the lever. In particular, in a case where a retaining protrusion configured to retain and lock the lever is provided on the boss portion, an attaching angle of the lever with respect to the connector body must also be visually checked.

SUMMARY

Illustrative aspects of the present invention provide a lever-type connector having excellent attaching workability, in which a lever can be easily aligned with a connector body.

According to an illustrative aspect of the present invention, a lever-type connector includes a connector body including a pair of side walls and a boss portion protruding from an outer surface of each of the pair of side walls and a lever including a pair of arm portions, each of the pair of arm portions being provided with a boss fitting hole into which the boss portion of the connector body is to be inserted, the lever being configured to be rotatably attached to the connector body. The lever is configured, by being rotated, to apply a force on the connector body such that the connector body is attached to and detached from a mating connector. The connector body includes a first alignment mark and the lever includes a second alignment mark, the first alignment mark and the second alignment mark being visually recognizable while the lever is being attached to the connector body. The lever is configured, by aligning the second alignment mark with the first alignment mark such that the first alignment mark and the second alignment mark are opposed to each other, to be rotatably attached to the connector body with a position of the boss portion and a position of the fitting hole being aligned with each other, allowing the boss portion to be inserted into the boss fitting hole.

Other aspects and advantages of the invention will be apparent from the following description, the drawings and the claims.

BRIEF DESCRIPTION OF THE DRAWINGS

FIGS. 5A and 5B show a procedure of attaching the lever to the connector body, in which FIG. 5A is a side view after attaching the lever to the connector body, and in which FIG. 5B is a side view of a state where the lever is rotated to be in a temporary locking position;

FIGS. 9A and 9B show a procedure for attaching the lever to the connector body, in which FIG. 9A is a side view while the lever is being attached to the connector body, and in which FIG. 9B is a side view after attaching the lever to the connector body.

DETAILED DESCRIPTION

Figure 1:
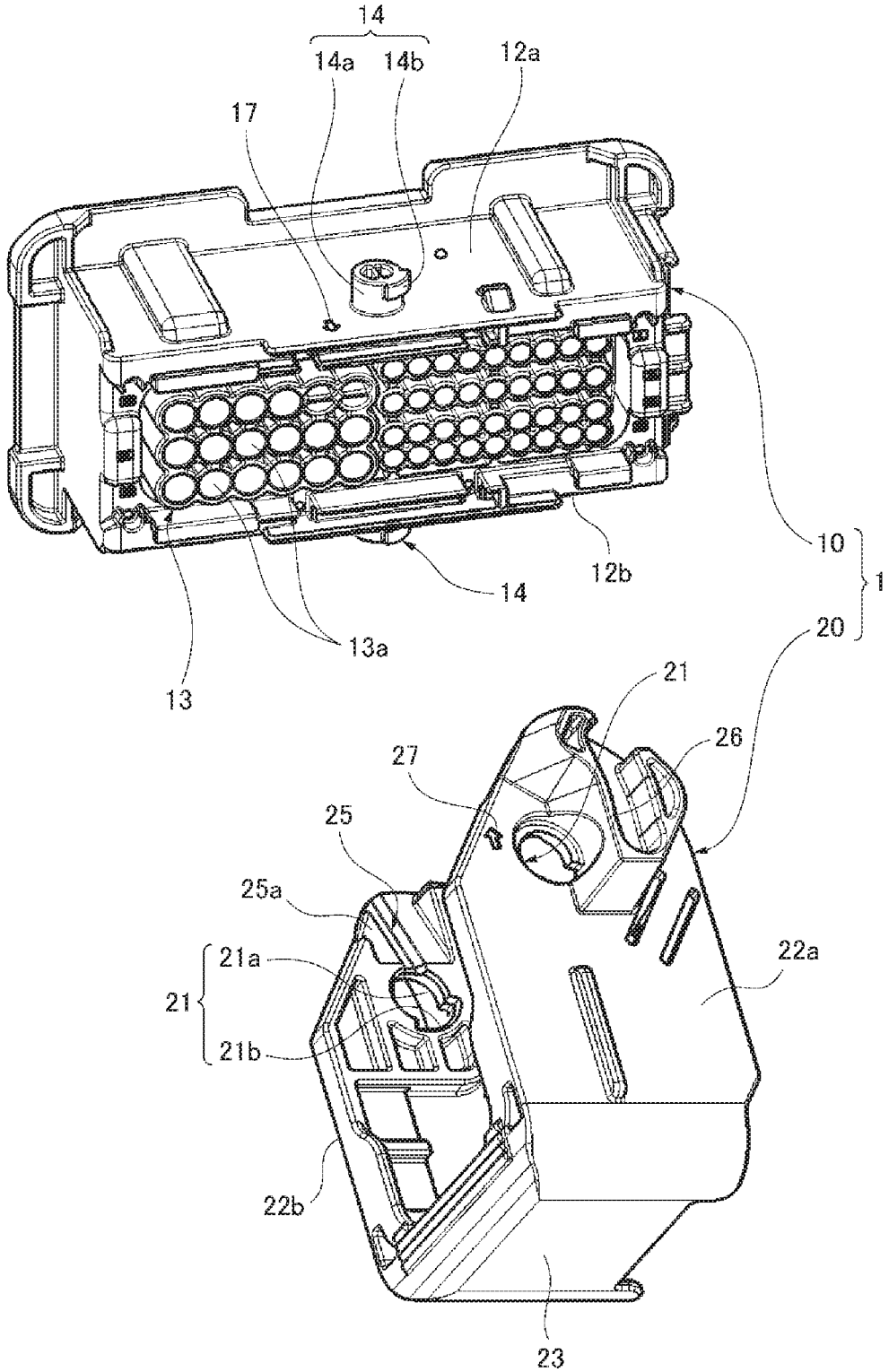
FIG. 1 is a perspective view showing a lever-type connector according to an embodiment of the present invention before attaching a lever to a connector body.
Figure 2:
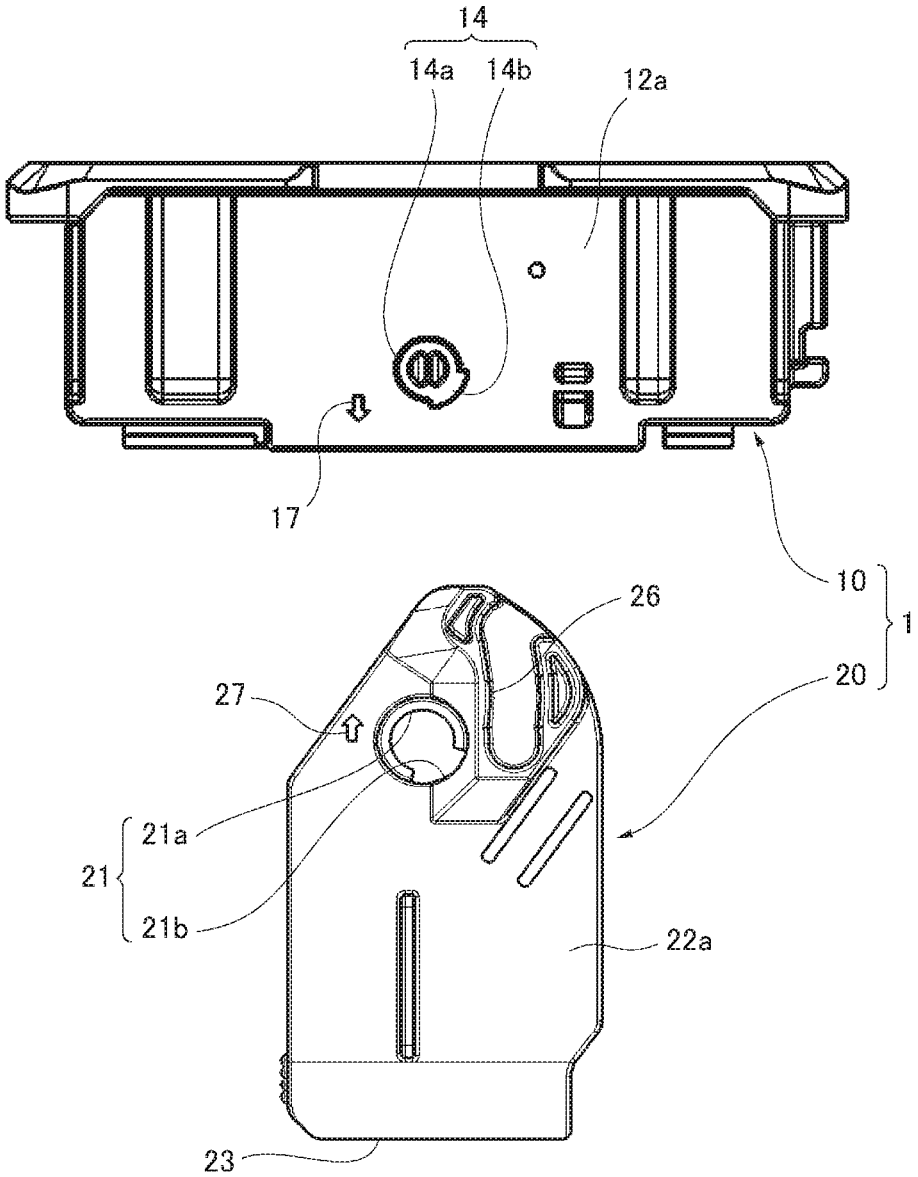
FIG. 2 is a side view showing the lever-type connector according to the embodiment before attaching the lever to the connector body.
Figure 3:
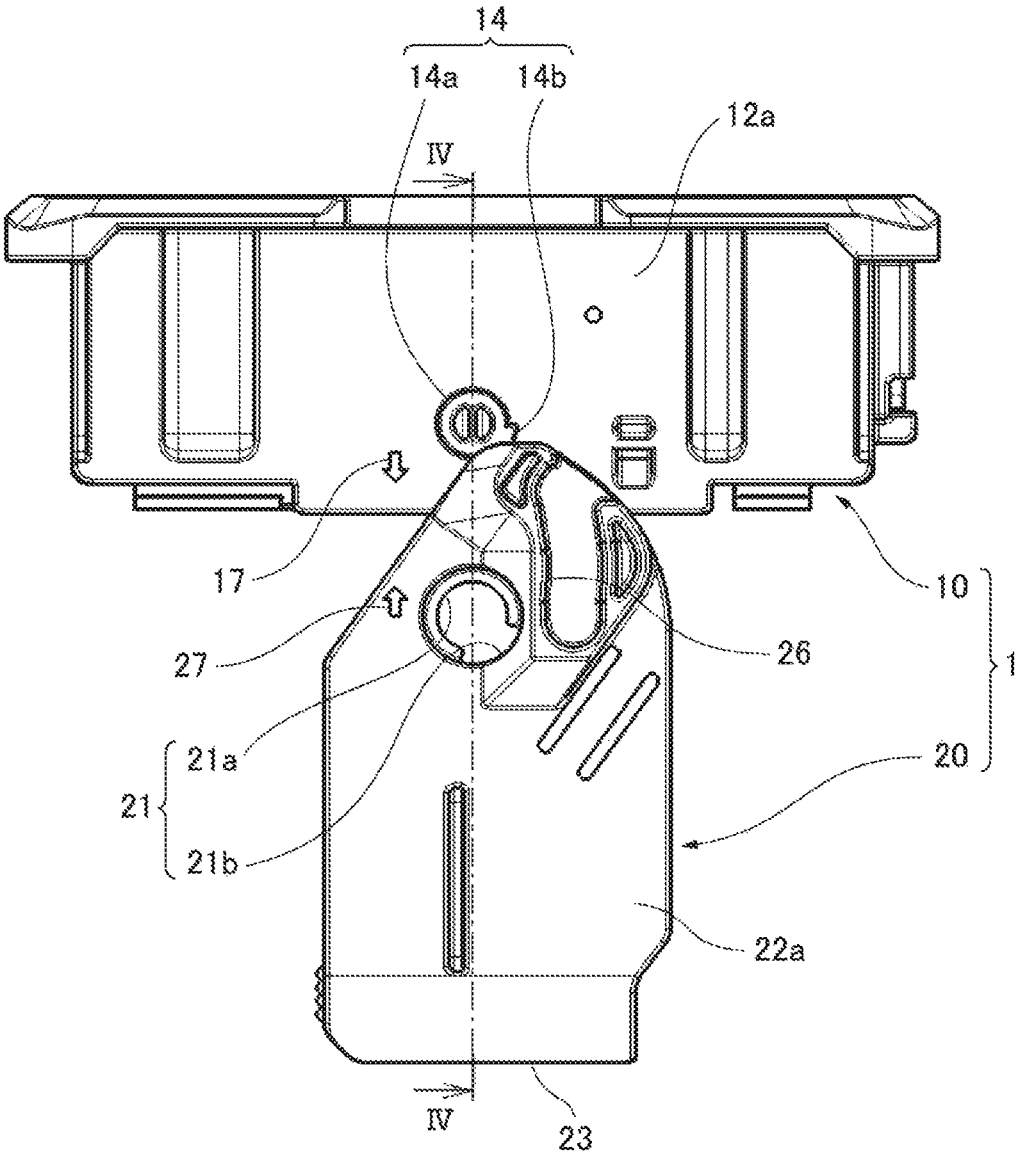
FIG. 3 is a side view showing the lever-type connector according to the embodiment while the lever is being attached to the connector body.
Figure 4:
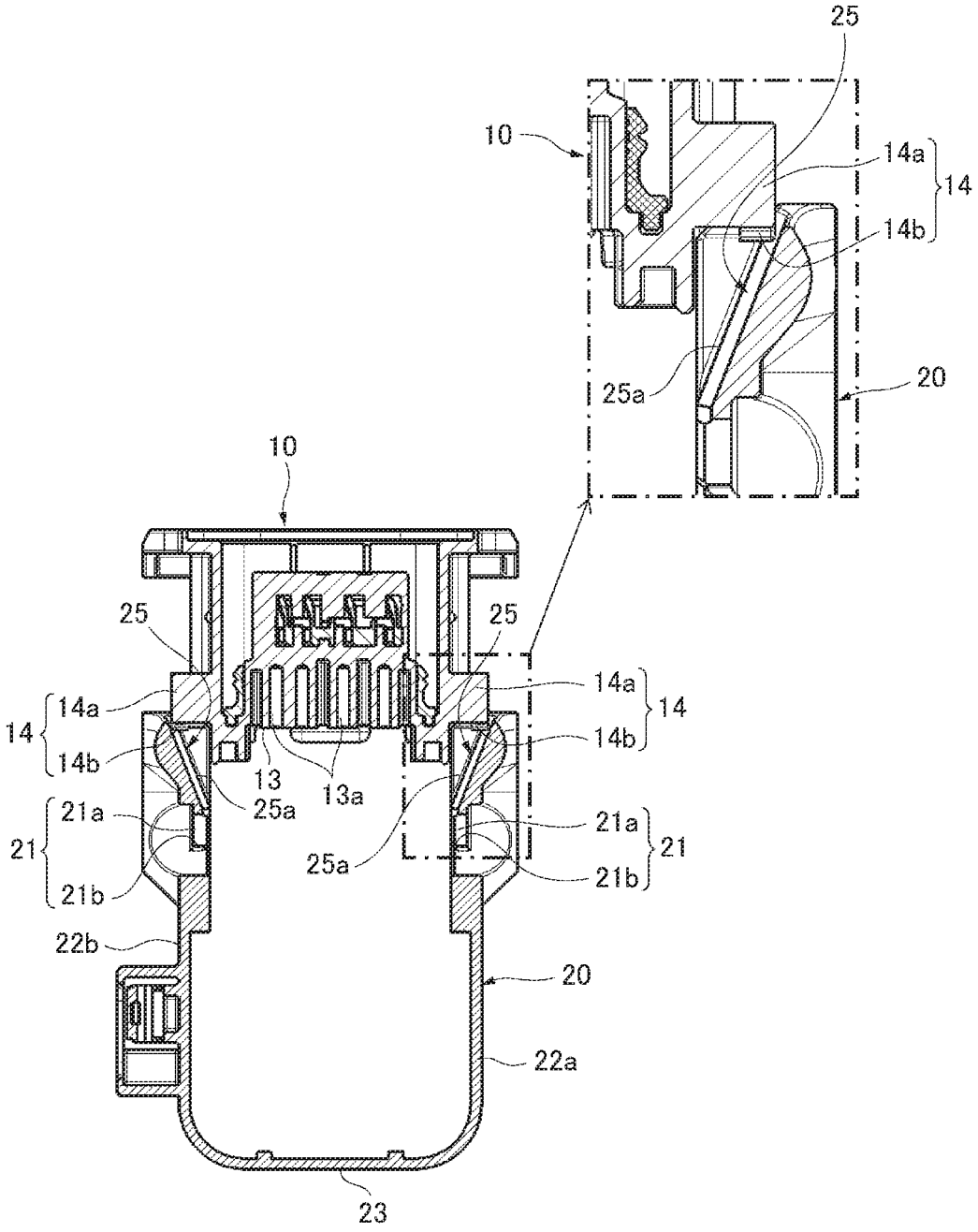
FIG. 4 is a cross-sectional view taken along line IV-IV of FIG. 3 and is a partially enlarged view.

Hereinafter, exemplary embodiments of the present invention will be described in detail with reference to the drawings, FIG. 1 is a perspective view showing a lever-type connector 1 according to an embodiment of the present invention before attaching a lever 20 to a connector body 10. FIG. 2 is a side view showing the lever-type connector 1 according to the embodiment before attaching the lever 20 to the connector body 10. FIG. 3 is a side view showing the lever-type connector 1 according to the embodiment during attaching the lever 20 to the connector body 10. FIG. 4 is a cross-sectional view taken along line IV-IV of FIG. 3 and is a partially enlarged view.

As shown in FIGS. 1 to 4, the lever-type connector 1 according to the embodiment includes the connector body 10 configured to be fitted and connected to a mating connector (not shown) and the lever 20 configured to be attached to the connector body 10 from a rear side of the connector body 10.

The connector body 10 includes a terminal accommodating portion 13 which includes a plurality of terminal accommodating chambers 13*a*, a pair of side walls 12*a*, 12*b* arranged to face each other, the pair of side walls 12*a*, 12*b* extending from upper and lower sides of the terminal accommodating portion 13 and a boss portion 14 configured to support the lever 20 and protrudes from outer surfaces of the pair of side walls 12*a*, 12*b*. A terminal fitting (not shown) to which a terminal of an electric wire (not shown) is to be crimped and connected is to be accommodated and held in each terminal accommodating chamber 13*a*.

The boss portion 14 is a shaft configured to support the lever 20 such that the lever 20 is rotatable. The boss portion 14 includes a support shaft 14*a* having a cylindrical shape, and a retaining protrusion 14*b* protruding laterally from an upper end of the support shaft 14*a*.

On one side wall 12*a* of the connector body 10 at a position in the vicinity of the boss portion 14, a body side mark (mark) 17 is provided, the body side mark 17 being visually recognizable even while the lever 20 is being attached to the connector body 10. The body side mark 17 is used for alignment of the lever 20 with respect to the connector body 10 when the lever 20 is attached to the connector body 10. The body side mark 17 is provided in the vicinity of an edge of the side wall 12*a*, the edge being on a side from which the lever 20 is to be attached to the connector body 10. The body side mark 17 is in the shape of an "arrow" indicating a direction, and a longitudinal direction of the shape of the arrow is arranged along a direction in which the lever 20 is attached to the connector body 10. The direction that the "arrow" of the body side mark 17 indicates is directed toward the lever 20.

The lever 20 includes a pair of arm portions 22*a*, 22*b* arranged such that each of the arm portions 22*a* and 22*b* face each other, and a coupling portion 23 coupling the arm portions 22*a*, 22*b* on one end side. The lever 20 is provided in a U-shape as a whole. In the lever 20, the coupling portion 23 is an operation portion, i.e., the lever 20 is rotated with respect to the connector body 10 by gripping the operation portion.

The arm portions 22*a*, 22*b* of the lever 20 are plate-shaped objects configured to cover the pair of side walls 12*a*, 12*b* of the connector body 10 when the lever 20 is attached to the connector body 10. Each of the arm portions 22*a*, 22*b* includes a boss fitting hole 21 into which the boss portion 14 is rotatably fitted. The arm portions 22*a*, 22*b* are configured to cover the outer surfaces of the pair of side walls 12*a*, 12*b* from the rear side of the connector body 10, and the boss portion 14 is to be inserted into each of the boss fitting holes 21. As a result, the arm portions 22*a*, 22*b* are attached to the pair of side walls 12*a*, 12*b* so as to be rotatable within a predetermined angle range around an axis line of the support shaft 14*a* of the boss portion 14 which serves as a rotation center.

The boss fitting hole 21 includes an inner peripheral protrusion 21*a* protruding radially inward from an inner peripheral wall of the boss fitting hole 21. The inner peripheral protrusion 21*a* is provided over a circumference of the boss fitting hole 21 except a portion of the circumference of the boss fitting hole 21, and the portion where the inner peripheral protrusion 21*a* is not provided serves as a protrusion insertion portion 21*b*. The inner peripheral protrusion 21*a* has an inner diameter which is slightly larger than an outer diameter of the support shaft 14*a* of the boss portion 14, and the protrusion insertion portion 21*b* has an inner shape which is slightly larger than an outer shape of the retaining protrusion 14*b* of the boss portion 14.

Inner surfaces of the arm portions 22*a*, 22*b* are provided with a boss guide groove 25 communicating the boss fitting hole 21. The boss guide groove 25 has a width dimension which is larger than an outer diameter of the boss portion 14. The boss guide groove 25 is provided from the boss fitting hole 21 toward edge portions of the arm portions 22*a*, 22*b*. A bottom surface of the boss guide groove 25 is a guide surface 25*a* which is gradually inclined inward from the edge portions of the arm portion 22*a*, 22*b* toward the boss fitting holes 21.

Among the arm portions 22*a*, 22*b* of the lever 20, one arm portion 22*a* covering the side wall 12*a* of the connector body 10 having the body side mark 17 is provided with a lever side mark (mark) 27 being on an outer surface thereof. The lever side mark 27 is visually recognizable even when the lever 20 is attached to the connector body 10 and is used for alignment of the lever 20 with respect to the connector body 10. The lever side mark 27 is provided in the vicinity of an edge of the arm portion 22*a*, the edge being on a side from which the lever 20 is to be attached to the connector body 10. The lever side mark 27 is in the shape of an "arrow" indicating a direction. A longitudinal direction of the shape of the "arrow" is arranged along a direction in which the lever 20 is attached to the connector body 10. The direction that the "arrow" of the lever side mark 27 indicates is directed toward the connector body 10.

A cam groove 26, which extends from the edge portions of the arm portions 22*a*, 22*b* to the vicinity of the boss fitting hole 21, is provided on outer surfaces of the arm portions 22*a*, 22*b*. One end of the cam groove 26 is opened at the edge portions of the arm portions 22*a*, 22*b*. A cam shaft (not shown) provided on the mating connector is to be inserted into the cam groove 26 from one end side which is opened.

Figure 5A:
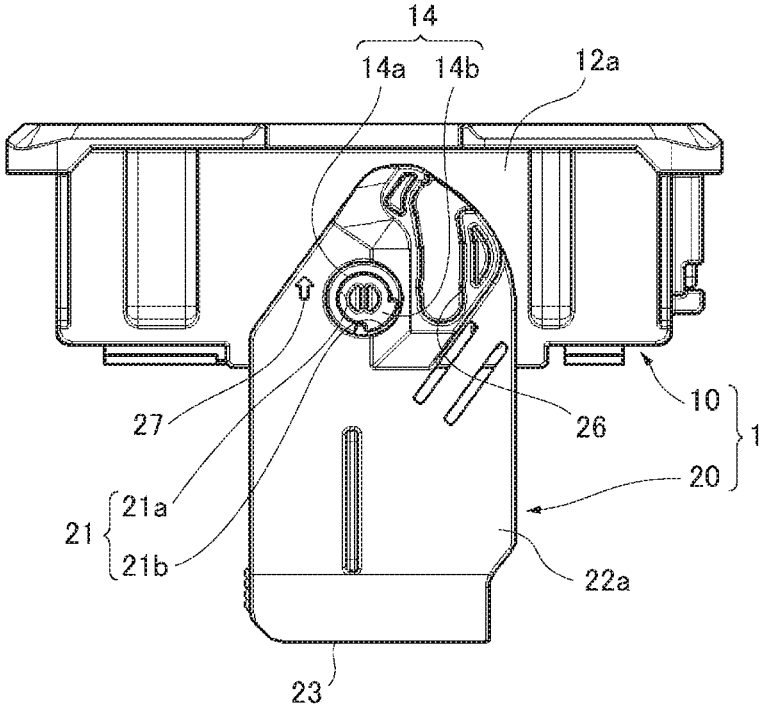
Figure 5B:
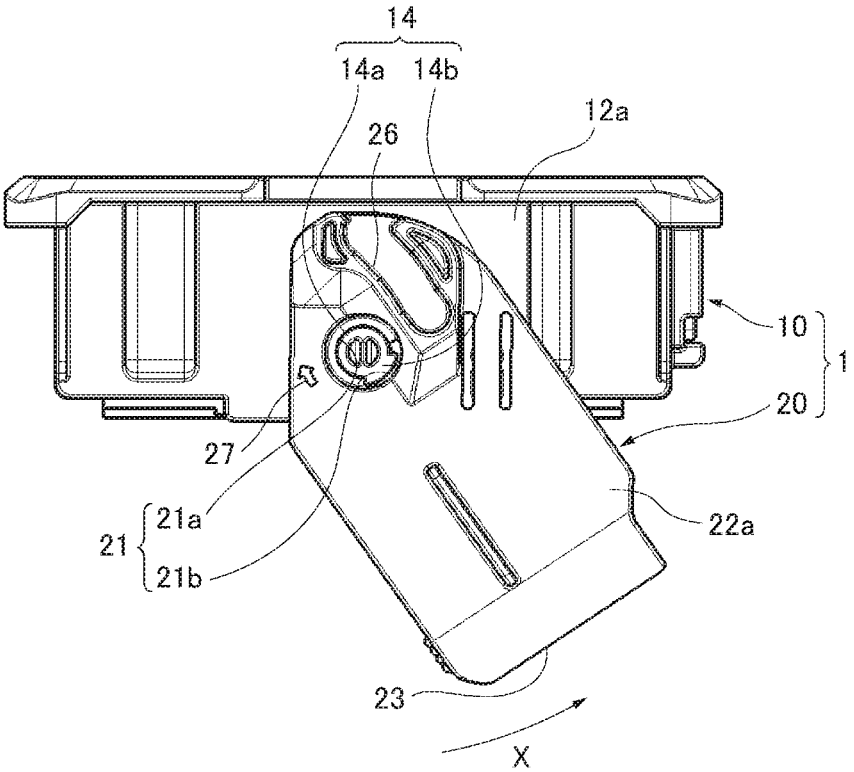

Next, a case where the lever 20 is attached to the connector body 10 will be described. FIGS. 5A and 5B show a procedure for attaching the lever 20 to the connector body 10, in which FIG. 5A is a side view after attaching the lever 20, and in which FIG. 5B is a side view of a state where the lever 20 is rotated to a temporary locking position.

First, as shown in FIG. 2, positions and directions of the body side mark 17 of the connector body 10 and the lever side mark 27 of the lever 20 are to be checked such that the directions indicated by the "arrows" of the body side mark 17 and the lever side mark 27 are opposed to each other. In other words, the body side mark 17 and the body side mark 27 are aligned such that the two arrows indicate two directions opposite to each other while the arrows being on a one straight line along longitudinal directions of the arrows. Then the position of the lever 20 in a direction orthogonal to the direction in which the lever 20 is attached to the connector body 10 and an attaching angle with respect to the connector body 10 are adjusted.

Next, as shown in FIG. 3, the lever 20 is brought close to the connector body 10 by being drawn in the direction indicated by the lever side mark 27. As shown in FIG. 4, then the boss portion 14 of the connector body 10 enters an edge portion of the boss guide groove 25 of the lever 2C) and abuts the guide surface 25*a*.

In this state, the lever 20 is pushed toward the connector body 10. Then the boss portion 14 slides on the guide surface 25*a* and moves relatively along the boss guide groove 25. As a result, the arm portions 22*a*, 22*b* are pushed outward and elastically deformed.

Thereafter, as shown in FIG. 5A, the boss portion 14 reaches the boss fitting hole 21 of the arm portions 22*a*, 22*b* of the lever 20. At this time, since the lever 20 is aligned with the connector body 10 by the body side mark 17 and the lever side mark 27, the retaining protrusion 14*b* of the boss portion 14 is aligned with the protrusion insertion portion 21*b* of the boss fitting hole 21. Therefore, when the boss portion 14 reaches the boss fitting hole 21, the elastically deformed arm portions 22*a*, 22*b* are restored, and the boss portion 14, which includes the support shaft 14*a* and the retaining protrusion 14*b*, is inserted into the boss fitting hole 21, which includes the inner peripheral protrusion 21*a* and the protrusion insertion portion 21*b*. When the boss portion 14 is being accommodated in the boss fitting hole 21, the retaining protrusion 14*b* of the boss portion 14 is disposed on an outer side than the inner peripheral protrusion 21*a* of the boss fitting hole 21.

When the boss portion 14 is being accommodated in the boss fitting hole 21, as shown in FIG. 5B, the lever 20 is rotated in one direction (direction of arrow X of FIG. 5B) with respect to the connector body 10, thereby putting the lever 20 in a temporary locking position with the one opened end of the cam groove 26 directed toward a direction from which the mating connector is to be attached to the connector body 10. In this state, the retaining protrusion 14*b* provided on the boss portion 14 of the arm portions 22*a*, 22*b* is disposed on an outer side of the inner peripheral protrusion 21*a* of the boss fitting hole 21, i.e., the inner peripheral protrusion 21*a* is disposed between the retaining protrusion 14*b* and the connector body 10. As a result, the retaining protrusion 14*b* is locked by the inner peripheral protrusion 21*a*. Consequently, the lever 20 is maintained in an attached state with respect to the connector body 10, and detachment of the lever 20 from the connector body 10 caused by application of an external force or the like is restrained.

In order to fit the lever-type connector 1 to the mating connector, the lever-type connector 1 is to be fitted to the mating connector with the lever 20 being in the temporary locking position, and the cam shaft provided on the mating connector is to be inserted into the cam groove 26 from one end side. Then, the lever 20 is rotated in the one direction (direction of arrow X of FIG. 5B) to be in a final locking position along the connector body 10. Then the cam shaft which is inserted into the one end of the cam groove 26 is relatively guided to the other end of the cam groove 26, the other end being in the vicinity of the boss fitting hole 21. As a result, the mating connector is pulled toward the connector body 10 and fitted thereto.

From this fitted state, when the lever 20 is rotated in the other direction (direction opposite to the direction of arrow X of FIG. 5B) to be in the temporary locking position, the cam shaft of the mating connector which has been drawn to the other end side of the cam groove 26 is pushed to the one end side of the cam groove 26. As a result, the mating connector is pushed out and separated from the connector body 10.

As described above, according to the lever-type connector 1 according to the embodiment, an operator visually checks whether the lever 20 are aligned with respect to the connector body 10 such that the directions of the "arrows" of the body side mark 17 of the connector body 10 and the lever side mark 27 of the lever 20 face each other, and then the operator pushes the connector body 10 and the lever 20 toward each other in the directions of the "arrows" indicate, to attach the connector body 10 and the lever 20. As a result, the boss portion 14 is inserted into the boss fitting hole 21 by aligning a position of the boss fitting hole 21 with a position of the boss portion 14, and the lever 20 is attached to the connector body 10 in a rotatable manner. Therefore, the lever 20 can be easily aligned with and attached to the connector body 10 without using a positioning jig or the like, and workability of attaching the lever 20 to the connector body 10 can be improved, thereby reducing a burden on the operator.

Even though the boss portion 14 includes the retaining protrusion 14*b* that is locked by the inner peripheral protrusion 21*a* of the boss fitting hole 21, a position of the retaining protrusion 14*b* can be aligned with the protrusion insertion portion 21*b* of the boss fitting hole 21 to allow the boss portion 14 to be insert into the boss fitting hole 21 simply by performing alignment of the body side mark 17 and the lever side mark 27 such that the body side mark 17 and the lever side mark 27 face each other and attaching the lever 20 to the connector body 10.

Figure 6:
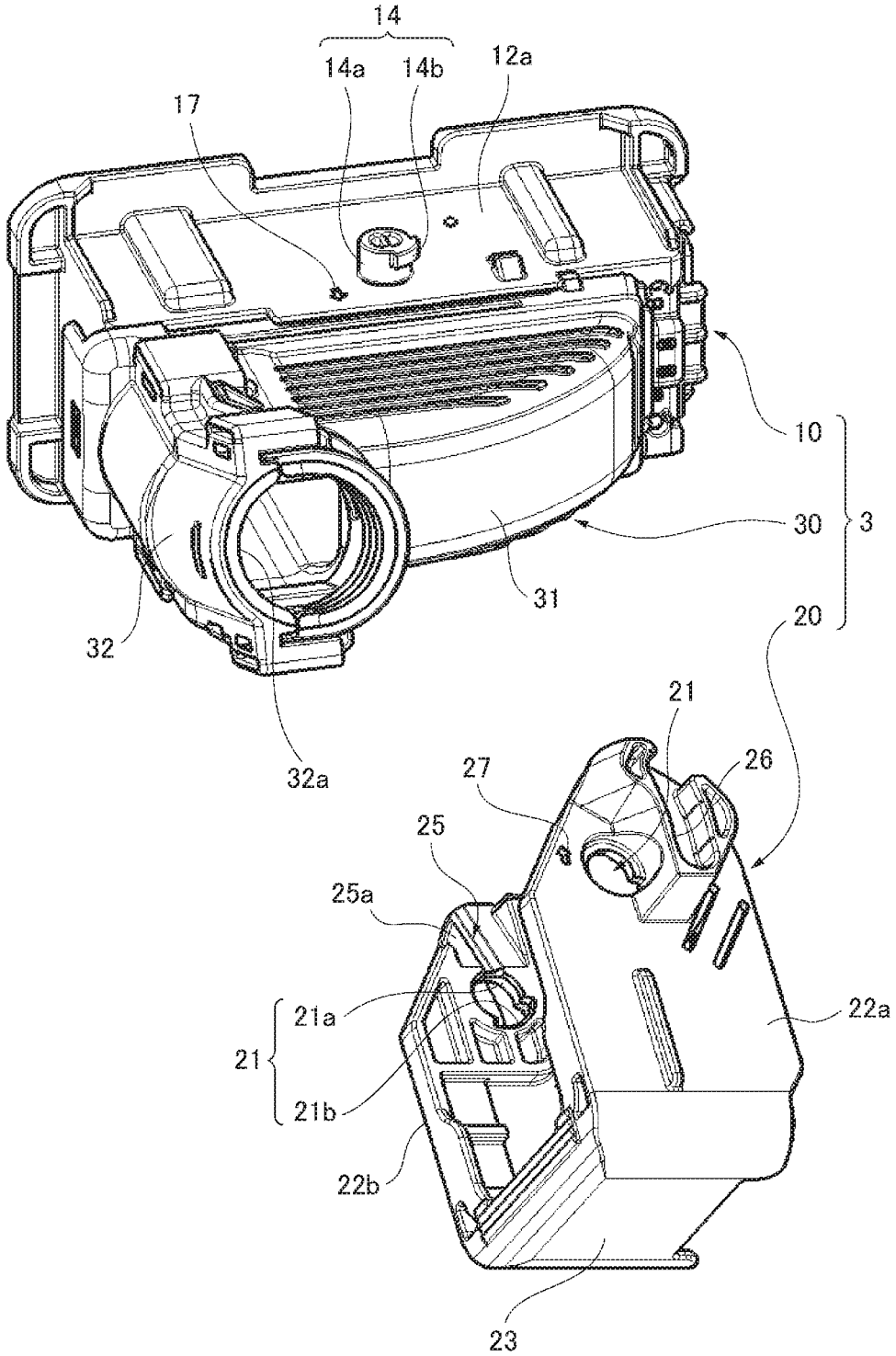
FIG. 6 is a perspective view showing a lever-type connector according to another embodiment of the present invention before attaching a lever to a connector body.
Figure 7:
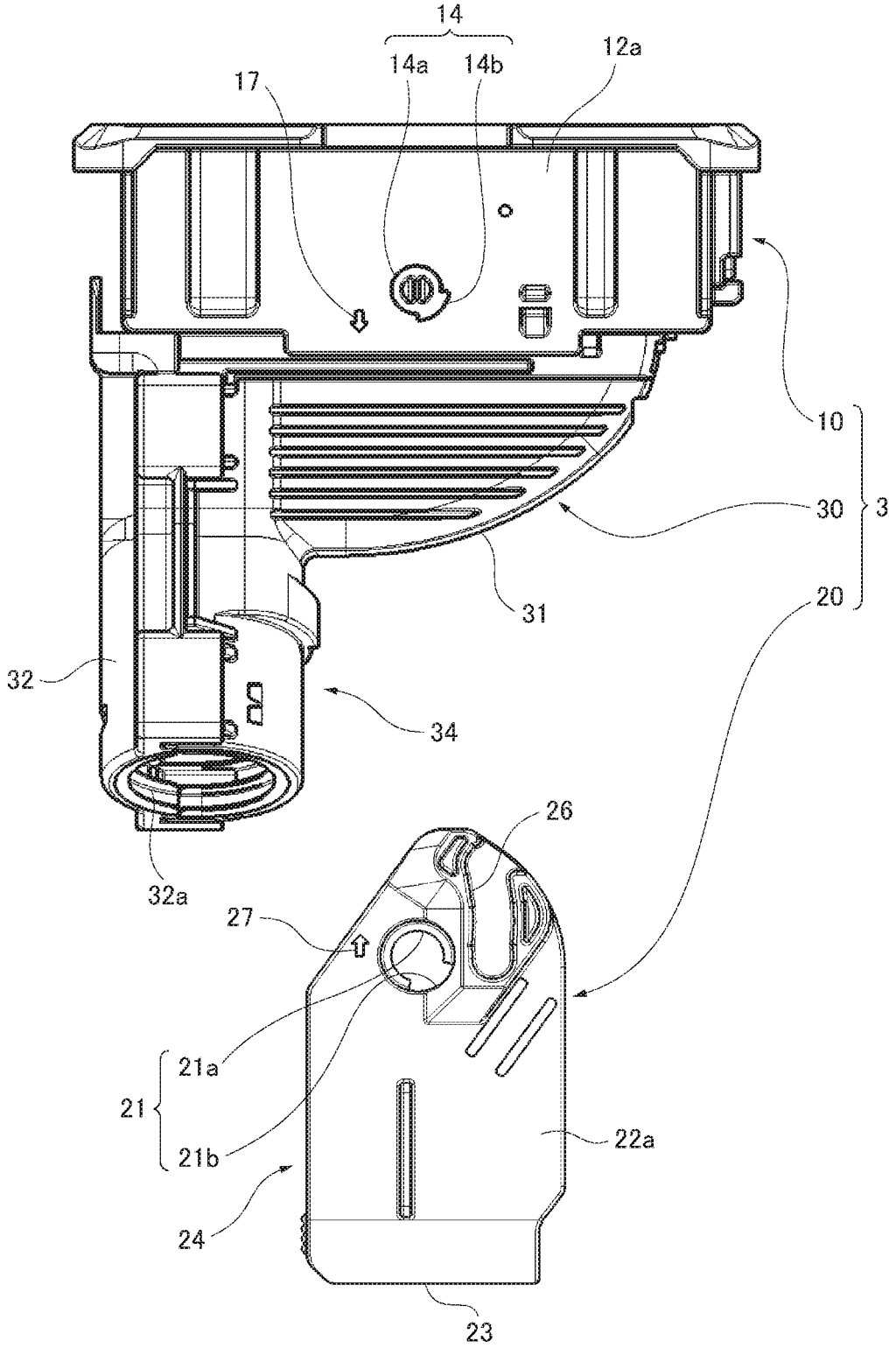
FIG. 7 is a side view showing the lever-type connector according to the another embodiment before attaching the lever to the connector body.
Figure 8:
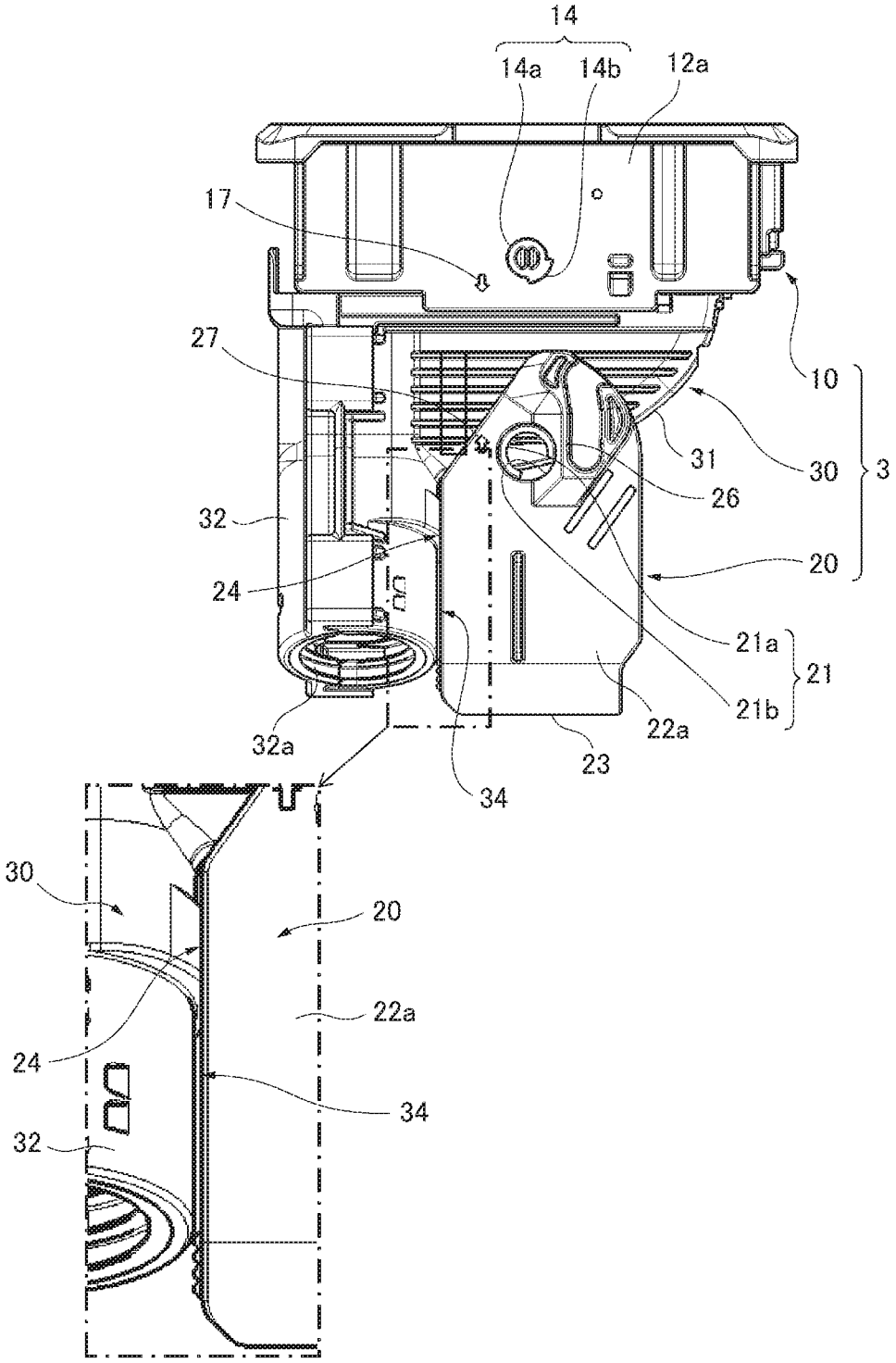
FIG. 8 is a side view showing the lever-type connector according to the another embodiment during attaching the lever, and is a partially enlarged view.

Next, a lever-type connector 3 according to another embodiment of the present invention will be described. In the another embodiment, the same components as those in the embodiment are denoted by the same reference numerals, and a description thereof is omitted. FIG. 6 is a perspective view showing the lever-type connector 3 according to the another embodiment of the present invention before attaching the lever 20. FIG. 7 is a side view showing the lever-type connector 3 according to the another embodiment before attaching the lever 20. FIG. 8 is a side view showing the lever-type connector 3 according to the another embodiment during attaching the lever 20, and is a partially enlarged view.

As shown in FIGS. 6 to 8, the lever-type connector 3 according to the another embodiment includes the connector body 10, the lever 20, and an electric wire cover 30 mounted to the connector body 10.

The electric wire cover 30 is mounted to a rear portion of the connector body 10 with is opposite to a side at which the connector body 10 is attached to the mating connector. As a result, in the connector body 10, the plurality of terminal accommodating chambers 13*a* of the terminal accommodating portion 13 are covered by the electric wire cover 30, and a plurality of electric wires (not shown) drawn out from the terminal accommodating chambers 13*a* are protected.

The electric wire cover 30 includes a cover body 31 attached to the rear portion of the connector body 10, and an electric wire lead-out portion 32 having a cylindrical shape, the electric wire lead-out portion 32 being provided on a rear portion of the cover body 31 on a side opposite to the side at which the cover body 31 is attached to the connector body 10. The electric wire lead-out portion 32 is provided on the rear portion of the cover body 31 and on one side of the cover body 31 in a longitudinal direction of the electric wire cover 30 and the connector body 10, the one side being opposite to another side of the longitudinal direction on which the lever 20 is to be mounted to the connector body 10. The electric wire lead-out portion 32 includes an electric wire lead-out opening 32*a* from which the plurality of electric wires (not shown) bundled and drawn out from the terminal accommodating chambers 13*a* of the terminal accommodating portion 13 of the connector body 10 are to be drawn out.

In the connector body 10 to which the electric wire cover 30 is mounted, the plurality of electric wires drawn out from the terminal accommodating chambers 13*a* of the terminal accommodating portion 13 are guided to the electric wire lead-out portion 32 by the cover body 31, bundled and collectively drawn out from the electric wire lead-out opening 32*a* of the electric wire lead-out portion 32.

In the electric wire cover 30 mounted to the connector body 10, a wall surface of the electric wire lead-out portion 32, the wall surface being to face the lever 20 when the lever 20 is attached to the connector body 10, serves as a guide portion 34. In the lever 20 which is attached to the connector body 10, edge portions of the arm portions 22*a*, 22*b*, the edge portions being to face the electric wire lead-out portion 32 of the electric wire cover 30, serve as a sliding portion 24.

Figure 9A:
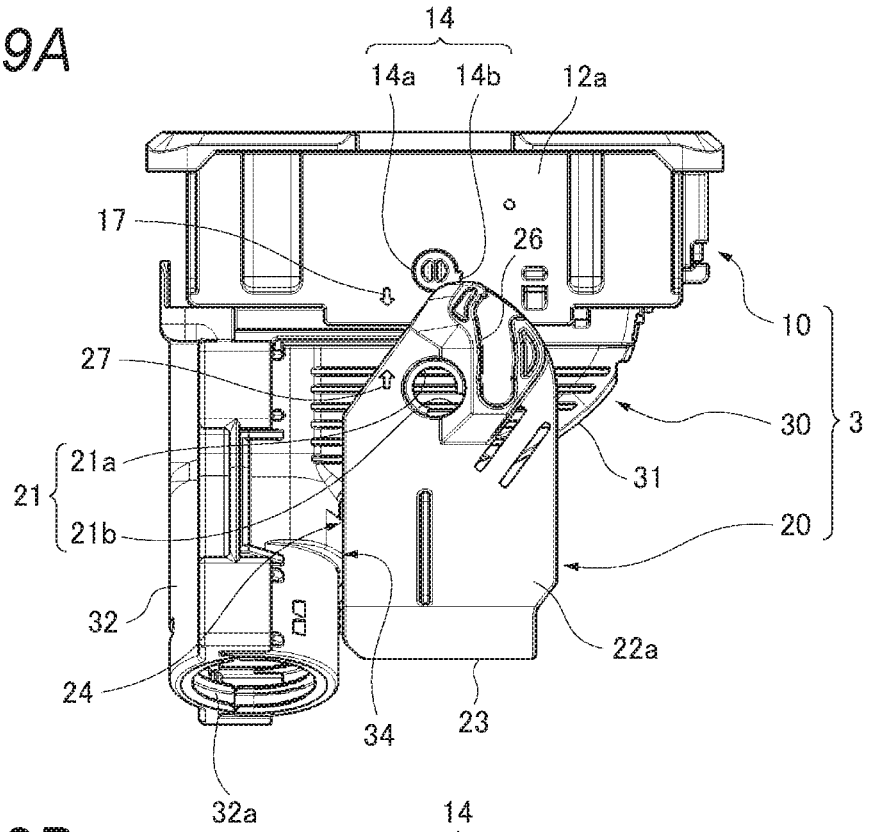
Figure 9B:
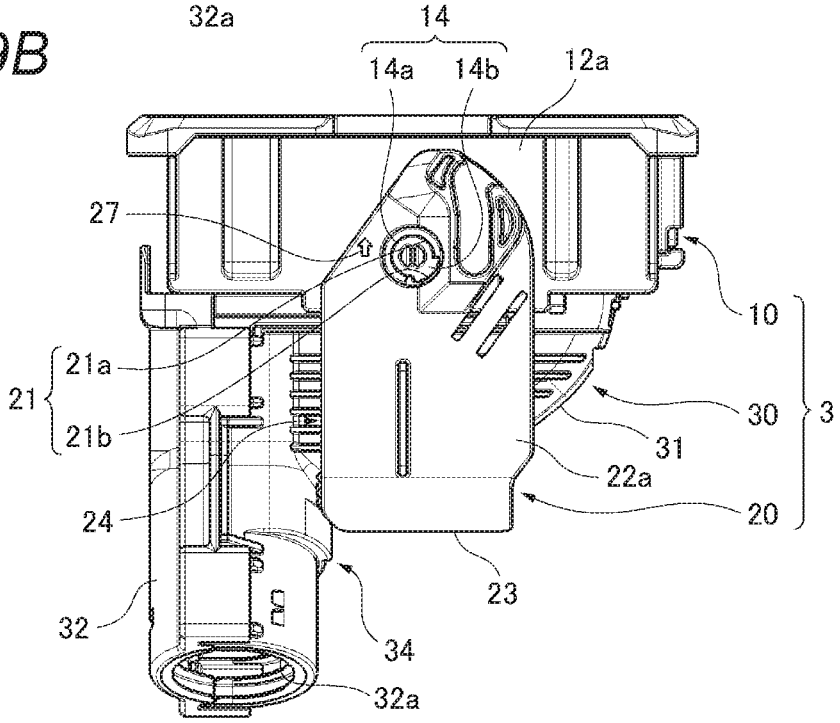
Figure 10:
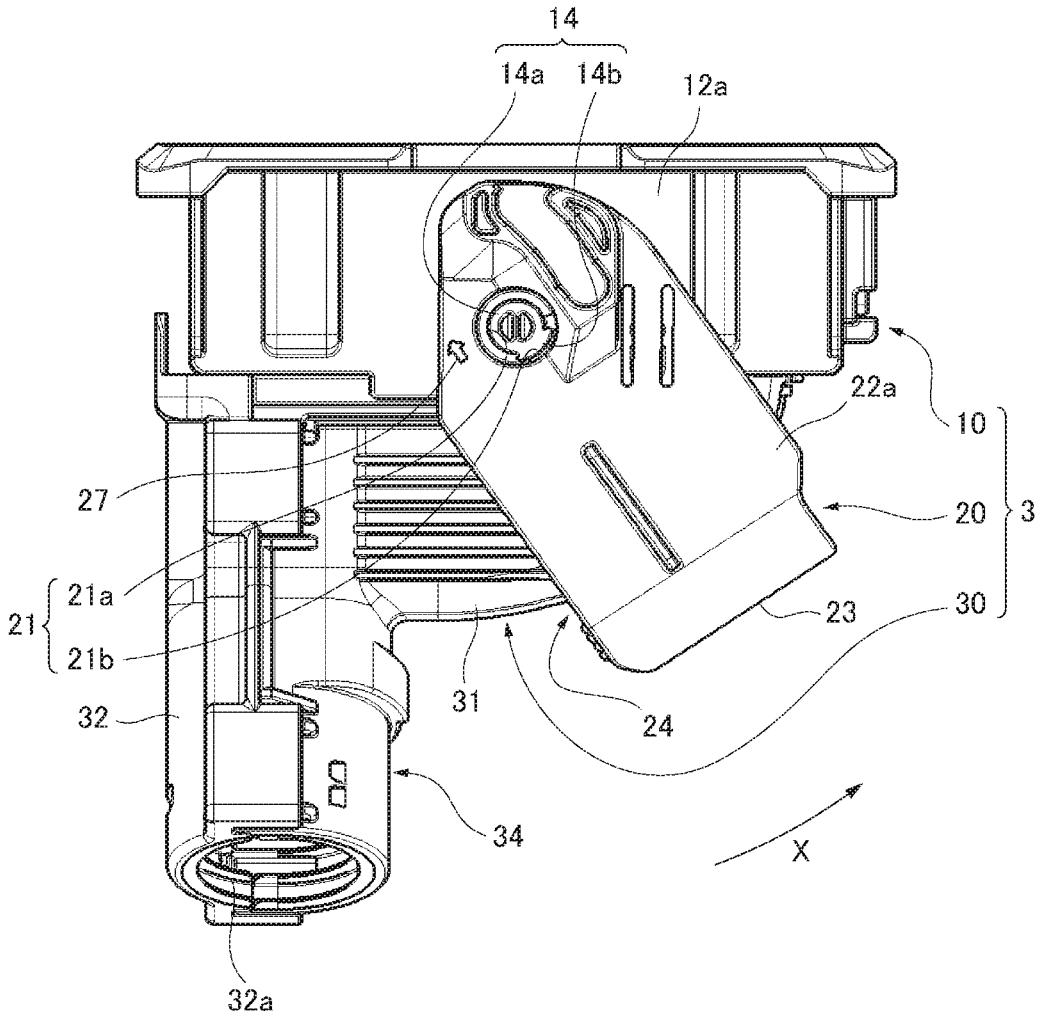
FIG. 10 shows the procedure for attaching the lever to the connector body, and is a side view of a state where the lever is rotated to be in the temporary locking position.

Next, how the lever 20 is to be attached to the connector body 10 to which the electric wire cover 30 is already attached will be described. FIG. 9A show a procedure for attaching the lever 20 to the connector body 10, in which FIG. 9A is a side view during attaching the lever 20, and in which FIG. 9B is a side view after attaching the lever 20. FIG. 10 shows the procedure for attaching the lever 20 to the connector body 10, and is a side view of a state where the lever 20 is rotated to the temporary locking position.

First, as shown in FIG. 8, positions and directions of the body side mark 17 of the connector body 10 and the lever side mark 27 of the lever 20 are to be checked such that the directions indicated by the "arrows" of the body side mark 17 and the lever side mark 27 face each other. Then the position of the lever 20 in the direction orthogonal to the direction in which the lever 20 is attached to the connector body 10 and the attaching angle with respect to the connector body 10 are adjusted. At this time, the sliding portion 24 of the arm portions 22*a*, 22*b* of the lever 20 abut the guide portion 34 of the electric wire lead-out portion 32 of the electric wire cover 30.

Next, as shown in FIG. 9A, the lever 20 is brought close to the connector body 10 by being drawn in the direction indicated by the lever side mark 27. Then the boss portion 14 of the connector body 10 enters the edge portion of the boss guide groove 25 of the lever 20 and abuts the guide surface 25*a* (see FIG. 4). From this state, the lever 20 is pushed into the connector body 10. Then the boss portion 14 slides on the guide surface 25*a* and moves relatively along the boss guide groove 25. As a result, the arm portions 22*b* are pushed outward and elastically deformed. At this time, by sliding the sliding portion 24 of the arm portions 22*a*, 22*b* with respect to the guide portion 34 of the electric wire lead-out portion 32, the position of the lever 20 in the direction orthogonal to the mounting direction with respect to the connector body 10 and the attaching angle of the lever 20 with respect to the connector body 10 are maintained.

Thereafter, as shown in FIG. 9B, the boss portion 14 reaches the boss fitting hole 21 of the arm portions 22*a*, 22*b* of the lever 20. At this time, since the lever 20 is aligned with the connector body 10 by the body side mark 17 and the lever side mark 27, the retaining protrusion 14*b* of the boss portion 14 is aligned with the protrusion insertion portion 21*b* of the boss fitting hole 21 in a plan view. Therefore, when the boss portion 14 reaches the boss fitting hole 21, the elastically deformed arm portions 22*a*, 22*b* are to be restored, and the boss portion 14, which includes the support shaft 14*a* and the retaining protrusion 14*b*, is inserted into the boss fitting hole 21 including the inner peripheral protrusion 21*a* and the protrusion insertion portion 21*b*. Then the retaining protrusion 14*b* of the boss portion 14 is disposed on the outer side than the inner peripheral protrusion 21*a* of the boss fitting hole 21.

With the boss portion 14 being inserted into the boss fitting hole 21, as shown in FIG. 10, the lever 20 is rotated in one direction (direction of arrow X of FIG. 10) with respect to the connector body 10, thereby putting the lever 20 in a temporary locking position with the one opened end of the cam groove 26 directed toward a direction from which the mating connector is to be attached to the connector body 10. In this state, the retaining protrusion 14*b* provided on the boss portion 14 of the arm portions 22*b* is disposed on the outer side of the inner peripheral protrusion 21*a* of the boss fitting hole 21, i.e., the inner peripheral protrusion 21*a* is disposed between the retaining protrusion 14*b* and the connector body 10. As a result, the retaining protrusion 14*b* is locked by the inner peripheral protrusion 21*a*. Consequently, the lever 20 is maintained in the attached state with respect to the connector body 10, and detachment of the lever 20 from the connector body 10 caused by application of an external force or the like is restrained.

As described above, in the case of the lever-type connector 3 according to the another embodiment, an operator visually checks whether the lever 20 are aligned with respect to the connector body 10 such that the directions of the "arrows" of the body side mark 17 of the connector body 10 and the lever side mark 27 of the lever 20 face each other, and then the operator pushes the connector body 10 and the lever 20 toward each other in the directions of the "arrows" indicate, to attach the connector body 10 and the lever 20. As a result, the boss portion 14 is inserted into the boss fining hole 1 by aligning a position of the boss fining hole 21 with a position of the boss portion 14, and the lever 20 is attached to the connector body 10 in a rotatable manner. Therefore, the lever 20 can be easily aligned with and attached to the connector body 10 without using a positioning jig or the like, and workability of attaching the lever 20 to the connector body 10 can be improved, thereby reducing a burden on the operator.

Furthermore, when the lever 20 is attached to the connector body 10 with the body side mark 17 and the lever side mark 27 aligned with each other, by making the sliding portion 24 of the aria portions 22*a*, 22*b* of the lever 20 slide on the guide portion 34 of the electric wire cover 30, the lever 20 can be guided in the direction in which the lever 20 is attached to the connector body 10. As a result, the workability of attaching the lever 20 to the connector body 10 can be further improved.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

For example, although the body side mark 17 is provided on the one side wall 12*a* of the connector body 10, and the lever side mark 27 is provided on the one arm portion 22*a* of the lever 20 in the above example, the body side mark 17 may be provided on both of the side walls 12*a*, 12*b* of the connector body 10, and the lever side mark 27 may be provided on both of the arm portions 22*a*, 22*b* of the lever 20. Moreover, although the marks provided on the connector body 10 and the lever 20 are "arrows" in the above example, various figures and symbols, such as a circle or a triangle, may be used as the marks.

According to an aspect of the embodiments described above, a lever-type connector (1, 3) includes a connector body (10) including a pair of side walls and a boss portion (14) protruding from an outer surface of each of the pair of side walls and a lever (20) including a pair of arm portions (22*a*, 22*b*), each of the pair of arm portions (22*a*, 22*b*) being provided with a boss fitting hole (21) into which the boss portion (14) of the connector body (10) is to be inserted, the lever (20) being configured to be rotatably attached to the connector body (10). The lever (20) is configured, by being rotated, to apply a force on the connector body (10) such that the connector body (10) is attached to and detached from a mating connector. The connector body (10) includes a first alignment mark (for example, a body side mark 17) and the lever (20) includes a second alignment mark (for example, a lever side mark 27), the first alignment mark (body side mark 17) and the second alignment mark (lever side mark 27) being visually recognizable while the lever (20) is being attached to the connector body (10). The lever (20) is configured, by aligning the second alignment mark (lever side mark 27) with the first alignment mark (body side mark 17) such that the first alignment mark (body side mark 17) and the second alignment mark (lever side mark 27) are opposed to each other, to be rotatably attached to the connector body (10) with a position of the boss portion (14) and a position of the fitting hole (21) being aligned with each other, allowing the boss portion (14) to be inserted into the boss fitting hole (21).

According to the lever-type connector having the above configuration, an operator can visually check whether the marks on the connector body and the lever are aligned such that the marks face each other. The lever can be attached to the connector body with the position of the boss fitting hole being aligned with the position of the boss portion, thereby allowing the boss portion to be inserted into the boss fitting hole and the lever to be attached to the connector body in the rotatable manner. Therefore, the lever can be easily aligned with and attached to the connector body without using a positioning jig or the like, and workability of attaching the lever to the connector body can be improved, thereby reducing a burden on the operator.

The first alignment mark (body side mark 17) may be a first arrow and the second alignment mark (lever side mark 27) may be a second arrow, the first arrow indicating a first direction in which the connector body (10) is attached to the lever (20), the second arrow indicating a second direction in which the lever (20) is attached to the connector body (10). The lever (20) may be configured to be attached to the connector body (10) with the second arrow being opposed to the first arrow.

According to the lever-type connector having the above configuration, by aligning the lever with the connector body such that the directions indicated by the "arrows" provided respectively on the connector body and the lever are opposed to each other, the position of the boss fitting hole can be aligned with the position of the boss portion, the boss portion can be inserted into the boss fitting hole, and the lever can be attached to the connector body in the rotatable manner.

The boss fitting hole (21) may include an inner peripheral protrusion (21*a*) protruding from an inner peripheral wall of the boss fitting hole (21), the inner peripheral protrusion (21*a*) extending in a peripheral direction of the boss fitting hole (21) except a part of the inner peripheral wall in the peripheral direction, the part being a protrusion insertion portion (21*b*). The boss portion (14) may include a retaining protrusion (14*b*) protruding from the boss portion (14), the retaining protrusion (14*b*) extending laterally outward with respect to the boss portion (14), the retaining protrusion (14*b*) being configured to be locked by the inner peripheral protrusion (21*a*) allowing the arm portions (22*a*, 22*b*) of the lever (20) to be kept attached to the connector body (10). The boss fitting hole (21) may be configured, by aligning the second alignment mark (lever side mark 27) with the first alignment mark (body side mark 17) such that the first and second alignment marks are opposed to each other, such that a position of the protrusion insertion portion (21*b*) is aligned with a position of the retaining protrusion (14*b*) allowing the boss portion (14) to be inserted into the boss fitting hole (21).

According to the lever-type connector having the above configuration, the position of the retaining protrusion can be aligned with the protrusion insertion portion to allow the boss portion to be inserted into the boss fitting hole simply by aligning the lever such that the marks faces each other when attaching the lever to the connector body. Moreover, when the lever is rotated after the boss portion is inserted into the boss fitting hole, the retaining protrusion of the boss portion, which is inserted through the protrusion insertion portion, is locked by the inner peripheral protrusion of the boss fitting hole. As a result, the lever can be maintained in a state of being attached to the connector body.

An electric wire cover (30) may be attached to the connector body (10), the electric wire cover (30) being configured to cover an electric wire drawn out from the connector body (10). The electric wire cover (30) may include a guide portion (34), a portion (for example, a sliding portion 24) of the lever (20) being configured to slide on the guide portion (34) while the lever (20) is being attached to the connector body (10).

According to the lever-type connector having the above configuration, when the lever is attached to the connector body with the marks aligned with each other, the portion of the lever contacts and slides on the guide portion of the electric wire cover such that the lever can be guided in the to the connector body. As a result, the workability of attaching the lever to the connector body can be further improved.

What is claimed is:

1. A lever-type connector comprising:

a connector body comprising a pair of side walls and a boss portion protruding from an outer surface of each of the pair of side walls; and a lever comprising a pair of arm portions, each of the pair of arm portions being provided with a boss fitting hole into which the boss portion of the connector body is to be inserted, the lever being configured to be rotatably attached to the connector body, wherein the lever is configured, by being rotated, to apply a force on the connector body such that the connector body is attached to and detached from a mating connector, wherein the connector body includes a first alignment mark and the lever includes a second alignment mark, the first alignment mark and the second alignment mark being visually recognizable while the lever is being attached to the connector body, wherein the lever is configured, by aligning the second alignment mark with the first alignment mark such that the first alignment mark and the second alignment mark are opposed to each other, to be rotatably attached to the connector body with a position of the boss portion and a position of the boss fitting hole being aligned with each other, the boss portion includes at least one of a retaining member and a receiving member with a predetermined orientation relative to the first alignment mark and the boss fitting hole includes a different one of the retaining member and the receiving member with a predetermined orientation relative to the second alignment mark, and the predetermined orientation of the retaining member corresponds to the predetermined orientation of the receiving member when the first alignment mark is aligned with the second alignment mark allowing the boss portion to be inserted into the boss fitting hole.

2. The lever-type connector according to claim 1, wherein the first alignment mark is a first arrow and the second alignment mark is a second arrow, the first arrow indicating a first direction in which the connector body is attached to the lever, the second arrow indicating a second direction in which the lever is attached to the connector body; and wherein the lever is configured to be attached to the connector body with the second arrow being opposed to the first arrow.

3. A lever-type connector comprising:

a connector body comprising a pair of side walls and a boss portion protruding from an outer surface of each of the pair of side walls; and a lever comprising a pair of arm portions, each of the pair of arm portions being provided with a boss fitting hole into which the boss portion of the connector body is to be inserted, the lever being configured to be rotatably attached to the connector body, wherein the lever is configured, by being rotated, to apply a force on the connector body such that the connector body is attached to and detached from a mating connector, wherein the connector body includes a first alignment mark and the lever includes a second alignment mark, the first alignment mark and the second alignment mark being visually recognizable while the lever is being attached to the connector body, wherein the lever is configured, by aligning the second alignment mark with the first alignment mark such that the first alignment mark and the second alignment mark are opposed to each other, to be rotatably attached to the connector body with a position of the boss portion and a position of the boss fitting hole being aligned with each other, allowing the boss portion to be inserted into the boss fitting hole, wherein the boss fitting hole comprises an inner peripheral protrusion protruding from an inner peripheral wall of the boss fitting hole, the inner peripheral protrusion extending in a peripheral direction of the boss fitting hole except a part of the inner peripheral wall in the peripheral direction, the part being a protrusion insertion portion, wherein the boss portion comprises a retaining protrusion protruding from the boss portion, the retaining protrusion extending laterally outward with respect to the boss portion, the retaining protrusion being configured to be locked by the inner peripheral protrusion allowing the arm portions of the lever to be kept attached to the connector body, and wherein the boss fitting hole is configured, by aligning the second alignment mark with the first alignment mark such that the first and second alignment marks are opposed to each other, such that a position of the protrusion insertion portion is aligned with a position of the retaining protrusion allowing the boss portion to be inserted into the boss fitting hole.

4. The lever-type connector according to claim 1, wherein an electric wire cover is attached to the connector body, the electric wire cover being configured to cover an electric wire drawn out from the connector body, and wherein the electric wire cover comprises a guide portion, a portion of the lever being configured to slide on the guide portion while the lever is being attached to the connector body.

5. The lever-type connector according to claim 1, the lever extends along a longitudinal direction, and the second alignment mark is adjacent to the boss fitting hole in a direction that is orthogonal to the longitudinal direction.

* * * * *